US006640341B1

(12) United States Patent
Calvert

(10) Patent No.: US 6,640,341 B1
(45) Date of Patent: Nov. 4, 2003

(54) HAND AND FINGER THIMBLES

(76) Inventor: Nathaniel Calvert, 3102 Crescent La. NW., Rochester, MN (US) 55903

( * ) Notice: Subject to any disclaimer, the term of this patent is extended or adjusted under 35 U.S.C. 154(b) by 0 days.

(21) Appl. No.: 10/178,298

(22) Filed: Jun. 24, 2002

Related U.S. Application Data

(62) Division of application No. 09/758,847, filed on Jan. 11, 2001, now Pat. No. 6,409,059.

(51) Int. Cl.[7] ..... A41D 19/00

(52) U.S. Cl. ..... 2/161.6; 2/161.3; 2/161.4; 2/163

(58) Field of Search ..... 2/159, 160, 161.6, 2/163, 164, 161.3, 167, 161.4

(56) References Cited

U.S. PATENT DOCUMENTS 4,638,511 A * 1/1987 Haack ..... 2/161.6
4,658,445 A * 4/1987 Tribble ..... 2/161.2
4,873,998 A * 10/1989 Joyner ..... 128/879
5,093,933 A * 3/1992 Berry ..... 2/161.6
6,055,669 A * 5/2000 Albert ..... 2/161.1

* cited by examiner

*Primary Examiner*—Bibhu Mohanty
(74) *Attorney, Agent, or Firm*—D L Tschida

(57) ABSTRACT

Single and two-sided hand and finger thimbles constructed to mount over the fingertips to provide non-slip gripping surfaces and improved protection at the fingertips and palm. Several thimbles include surfaces that contain impenetrable shields, elastomer pads or raised patterns of a coated elastomer. The coated thimbles facilitate paper separation, sorting, and counting. Plastic or metallic shields can fitted to shield and/or encase the fingertip. The shield can be exposed through an aperture and can include a pitted surface. Pull-tabs and elastic sizing members facilitate fitting the thimbles to the fingers. Alternative wrist supported, glove-like assemblies having one or more finger pieces fitted with shielding and gripping assemblies and padded palm regions are also disclosed.

13 Claims, 14 Drawing Sheets

HAND AND FINGER THIMBLES

This is a divisional application of Ser. No. 09/758,847, filed on Jan. 11, 2001, U.S. Pat. No. 6,409,059.

BACKGROUND OF THE INVENTION

The present invention relates to hand and finger covers for sewing and, in particular, to a number of pliant wrist and finger mounted thimbles constructed with a variety of alternative pull-tabs, exposed elastomer work surfaces and covered and uncovered rigid, impenetrable shields.

U.S. Pat. No. 4,944,437 discloses a leather thimble that has an elastic fitting member, a hand pull flap and a covered, rigid finger protection piece. This thimble has found general acceptance amongst professional sewers. The thimble is easily mounted to the finger and wears comfortably for long periods. The construction of the thimble however limits its use to a relatively few, specific applications. Repeated punctures of the leather also reduce useful thimble life.

Rubber fingertip covers are also known. Rubber finger covers find use in office settings when counting, sorting and separating paper. Although vents are provided in the covers, with extended use, the covers tend to induce perspiration. The perspiration, in turn, can produce sores or cause the cover to slip from the finger.

The present thimbles were therefore developed to provide alternative one and two-sided, fingertip protection for a variety of applications. A number of leather thimble constructions accommodate use in office and commercial sewing settings. Alternative sewn hems shape the thimbles to the fingertip and included gripping and shielded surfaces. The thimble fingertips include sewn elastomer pads and/or coated elastomer patterns. The thimbles also provide one or more impenetrable shields with recesses or projections that protect the tip and end of the finger and accommodate a work material. Glove or wrist supports are also shown wherein one or more fingers include rigid impenetrable shields and/or elastomer gripping surfaces.

SUMMARY OF THE INVENTION

It is accordingly a primary object of the invention to provide a hand and finger covers with improved fingertip protection and/or provide a non-slip work surface.

It is a further object of the invention to provide a leather thimble having an exposed elastomer work surface.

It is a further object of the invention to provide leather thimbles with one or more pull-tabs to facilitate fitting.

It is a further object of the invention to provide leather thimbles with non-slip work surfaces constructed from sewn elastomer pads or patterned elastomer coatings.

It is a further object of the invention to provide a one or two-sided leather thimble with rigid, impenetrable fingertip protection.

It is a further object of the invention to provide a leather thimble having a rigid, shield piece with an exposed, pitted work surface.

It is a further object of the invention to provide a leather thimble with multiple, rigid protection pieces that align to the tip and end surfaces of the finger.

It is a further object of the invention to provide a leather thimble with a rigid, sleeve or folding protection piece that contains or wraps over the tip and end surfaces of the finger.

It is a further object of the invention to provide alternative wrist supported thimbles that protect one or more fingers.

Many of the foregoing objects, advantages and distinctions of the invention are obtained in a number of alternative hand and finger protector constructions. A number of sewn leather finger thimbles particularly provide non-slip work surfaces that accommodate tasks such as counting money, paper etc. The fingertips of the thimbles include sewn elastomer pads, a layer of an elastomer coated fabric or a patterned elastomer coating.

A number of other alternative thimbles include rigid fingertip protection pieces. One, single-sided thimble provides a pitted shield piece that is exposed through an aperture at the fingertip. Other thimbles include multiple, rigid shield pieces that align with the tip and ends of the finger. Another thimble includes a continuous protection piece that wraps over and encases the end of a finger. Another thimble includes a tubular sleeve that encases the fingertip.

The various thimbles are constructed with one or two primary longitudinal seams. The seams can be exposed or inverted to the interior of the pliable shells. Elastic cross bands or sizing members can be fitted into the interiors of the thimbles to contain the thimbles to the finger. Pull-tabs are also provided to facilitate mounting the various thimbles to the finger.

A number of alternative wrist supports are also presented. The supports include one or more fingertips that appropriately support protective shields and/or elastomer gripping surfaces. The gripping surfaces can include the foregoing pads, layers or coatings. The finger piece can also be constructed of an elastomer material.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

BRIEF DESCRIPTION OF THE DRAWINGS

Similar structure at the drawings is referred to with the same reference numerals and/or characters.

DESCRIPTION OF THE PREFERRED EMBODIMENTS

Figure 1:
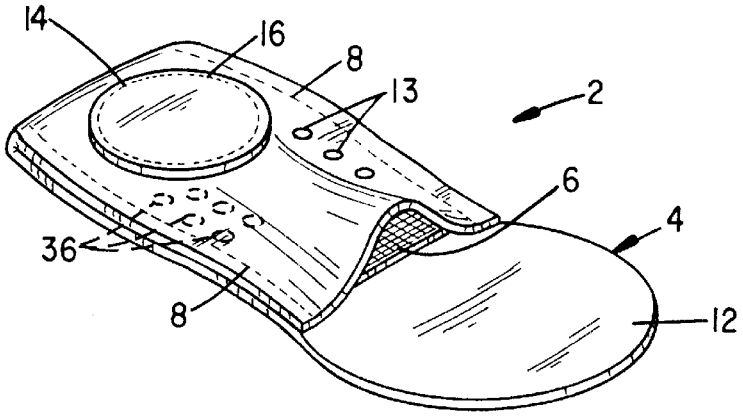
FIG. 1 is a perspective drawing showing a leather thimble with a stitched elastomer pad at the work surface.

Referring to FIG. 1, a thimble 2 is shown that provides a pliant shell or body member 4. The body member 4 is cut from a soft, durable material that is pliable and conforms to the shape of the distal phalange of a finger, such as leather or a coarse, stiff fabric. An elastic fitting or sizing member 6 is secured to the body 4 and the body 4 is folded back over itself. Two longitudinal seams 8 at the lateral sides of the thimble 2 secure the sizing member 6 and folded body 4 together. Although the seams 8 are shown exposed, the body 4 can be inverted with the seams aligning to the interior of the body 4. The position of the sizing member 6 can be mounted anywhere along the seams 8, although preferably above the fingernail. Multiple sizing members 6 can also be sewn to the body 4.

A pull-tab 12 is provided at the end of the thimble 2 to facilitate fitting the thimble 2 to the distal phalange. The opposite edge of the thimble 2 may also be cut with an arcuate extension piece 11, shown in dashed line at FIG. 5 that acts as a secondary pull-tab. Vent holes 13 can be provided as desired to allow air to circulate through the thimble 2. Elastomer grip-enhancing bumps 36 (shown in dashed line) can also be applied to the body 4. Such grip-enhancing features can be laminated or coated to the body 4.

An exposed elastomer pad 14 of a preferred shape is sewn to a preferred work surface with stitching 16. The stitching 16 may be embroidered over the peripheral edges of the pad 14 to prevent premature release. The pad 14 may also be sewn to the interior of the thimble 2 and exposed through an aperture (not shown) cut into the body 4.

The pad 14 can be cut from a natural, gum or silicone rubber, or an elastomer-impregnated material. These or any other material that has a high coefficient of friction relative to paper or another work object to be contacted with the pad 14 are preferred. Such materials ideally provide a non-slip and non-abrading contact with the work object. The size and shape of the pad 14 and mounting location at the thimble 2 is typically tailored to the application.

Figure 2:
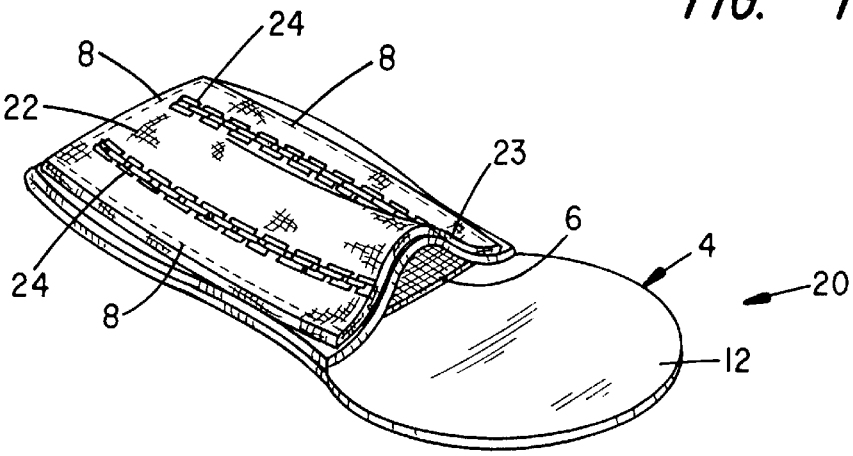
FIG. 2 is a perspective drawing showing a leather thimble with an appended pad containing a series of raised elastomer ribs.

FIG. 2 shows another thimble 20 that has a non-slip pad 22 stitched or laminated to cover the full length of one side of the thimble 20. The pad 22 includes a number of raised elastomer ribs 24 that extend longitudinally along the thimble 20 and between seams 8. The number, pattern, placement and orientation of the ribs 24 can be varied as desired. The ribs 24 are applied to a substrate 23 such as a fabric. A pair of pads 22 can be sewn to both sides of the thimble 20 or the pad 22 can be cut to wrap over the end to provide a two-sided thimble and increase the thimble's useful life. The pad 22 can also be secured with an adhesive, just as an adhesive or other fastener can be used to retain the edges of the body 4 together.

Figure 3:
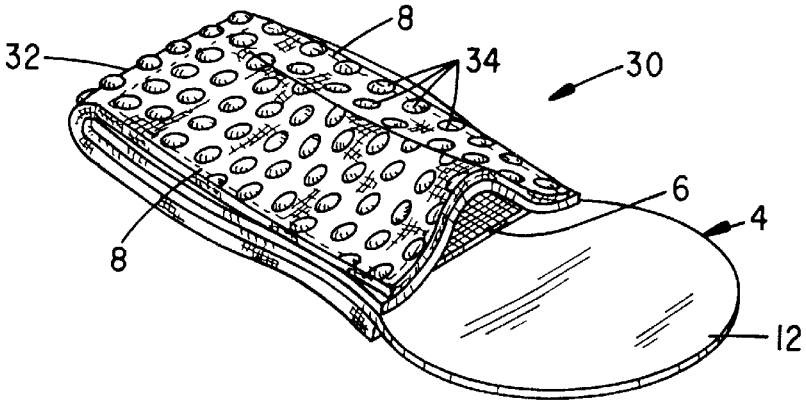
FIG. 3 is a perspective drawing showing a leather thimble with an appended pad containing a number of coated elastomer bumps.

FIG. 3 shows yet another thimble 30 that has a non-slip gripping surface. A non-slip, coated pad or substrate 32 includes a number of raised elastomer bumps 34. The substrate 32 is cut and wrapped over the end of the thimble to cover all sides in contact with the distal phalange. The thimble 30 can thus be rotated to present the opposite side as the bumps 34 wear off or become clogged or saturated with dirt.

Although the pads 14, 22 and 32 are readily sewn to the thimbles 2, 20 and 30, raised elastomer coatings can also be applied directly to the body member 4. Such coatings can be applied in any desired pattern. Exemplary bumps or spots 36 are shown in dashed line at FIG. 1. The bumps 36 are applied as a coating over the body member 4, which it is to be recalled can be constructed of leather, fabric, rubber or other desired pliant materials. The elastomer coating 36 should be selected to adhere to the substrate material and provide a desired useful life.

Figure 4:
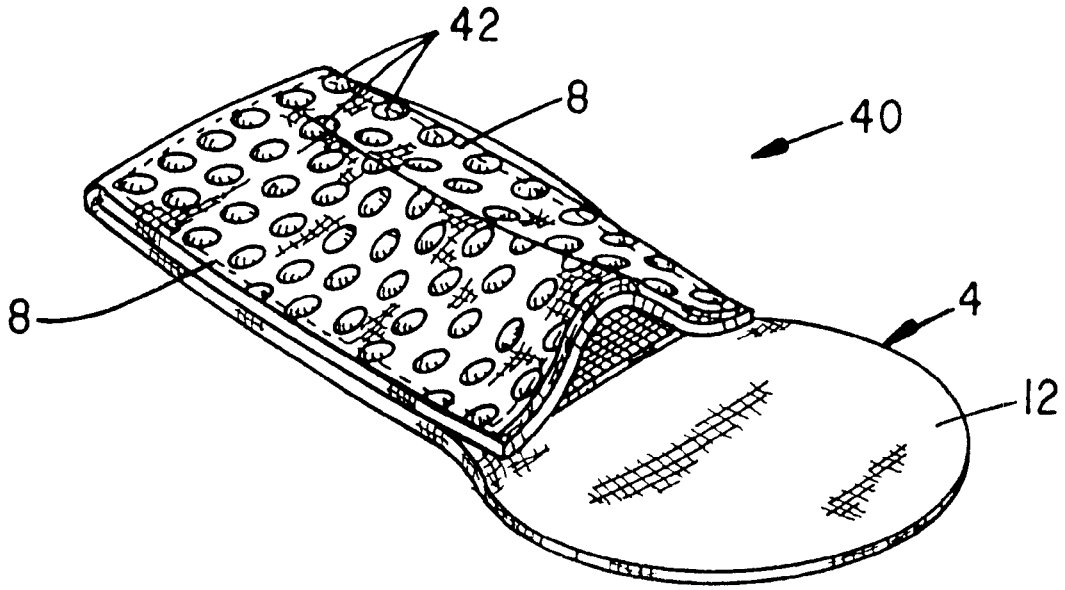
FIG. 4 is a perspective drawing showing a fabric thimble coated with elastomer bumps.
Figure 5:
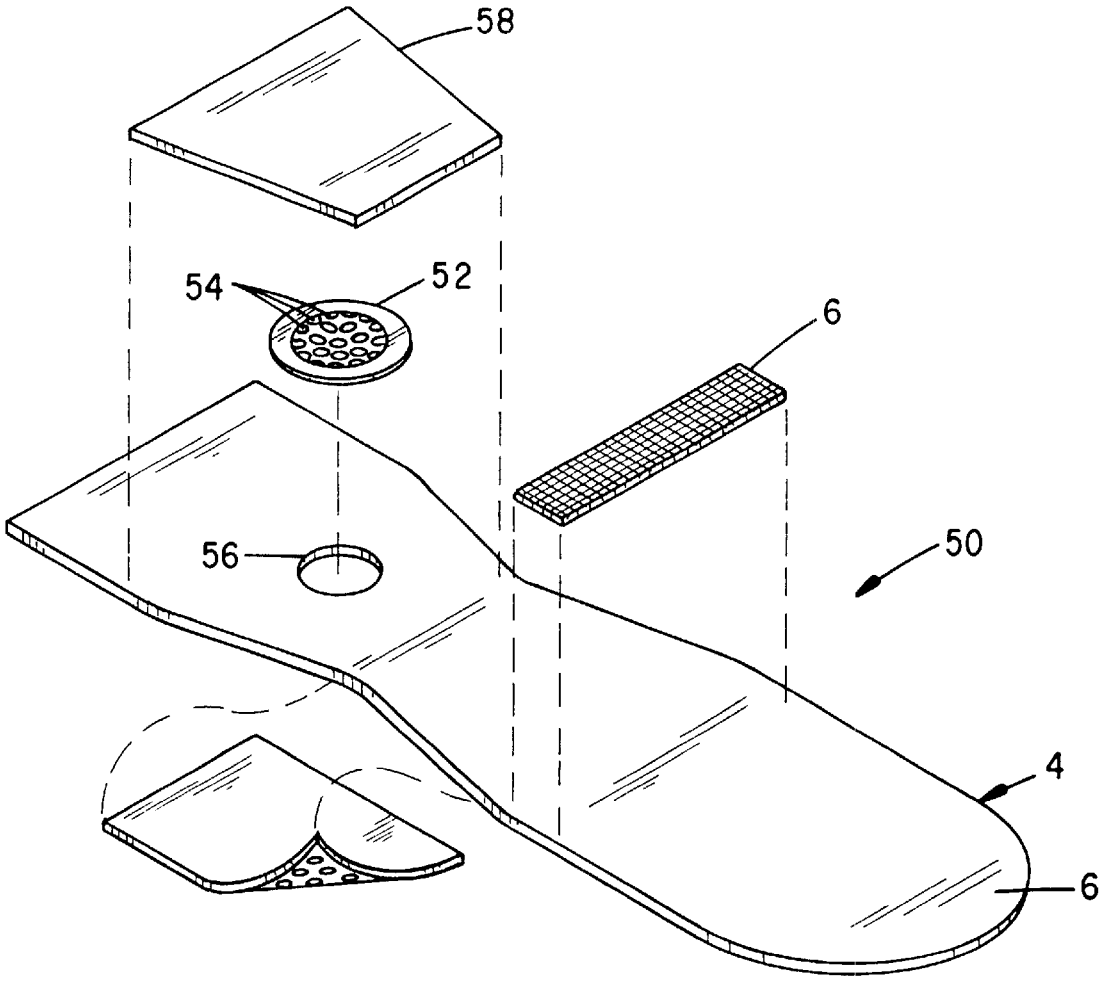
FIG. 5 is a perspective drawing shown in exploded assembly to a thimble with an exposed, pitted finger protector at the work surface.

FIG. 4 shows a thimble 40 that is constructed from a coarse fabric body 4 and coated with elastomer bumps 42. Numerous other thimble constructions having any variety of gripping surfaces and patterned coatings are possible.

Where the thimbles 2, 20, 30 and 40 provide non-slip gripping surfaces, the thimbles of FIGS. 5 through 9 discussed below are constructed to also provide improved protection from needle slippage and/or penetration. The thimble 50 of FIG. 5 includes an impenetrable metallic shield member 52 that provides a pitted surface containing numerous dimples or depressions 54. The shield 52 is exposed through a hole 56 in the body member 4. A backing tab 58 contains the shield 52 to the thimble 50 when the body 4 is folded and the tab 58, sizing member 6 and body 4 are sewn together. The tab 58 can be constructed of a fabric, leather or may comprise a second sizing member 6. The shape of the body member 4 shown at FIG. 5 is the same for all of the thimbles shown in FIGS. 5–9. The shape can be varied as desired, however, to enhance the ergonomics of the thimbles, for example, by including the abbreviated pull-tab extension 11.

The shield 52 provides a rigid, non-slip surface when supporting and pushing a needle. The depressions or dimples 54 accept and contain the end of a needle upon applying pressure and minimize possible slippage. By exposing the shield 52, wear is reduced at the body 4 that accrues from repeated penetrations. The shield 52 also provides protection against possible pricking of the finger with the point of an errant needle.

Figure 6:
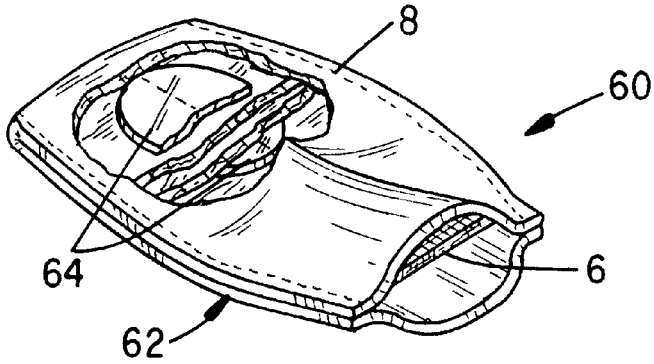
FIG. 6 is a perspective drawing shown in partial cutaway to a thimble without a pull flap and having two rigid fingertip shield pieces.
Figure 7:
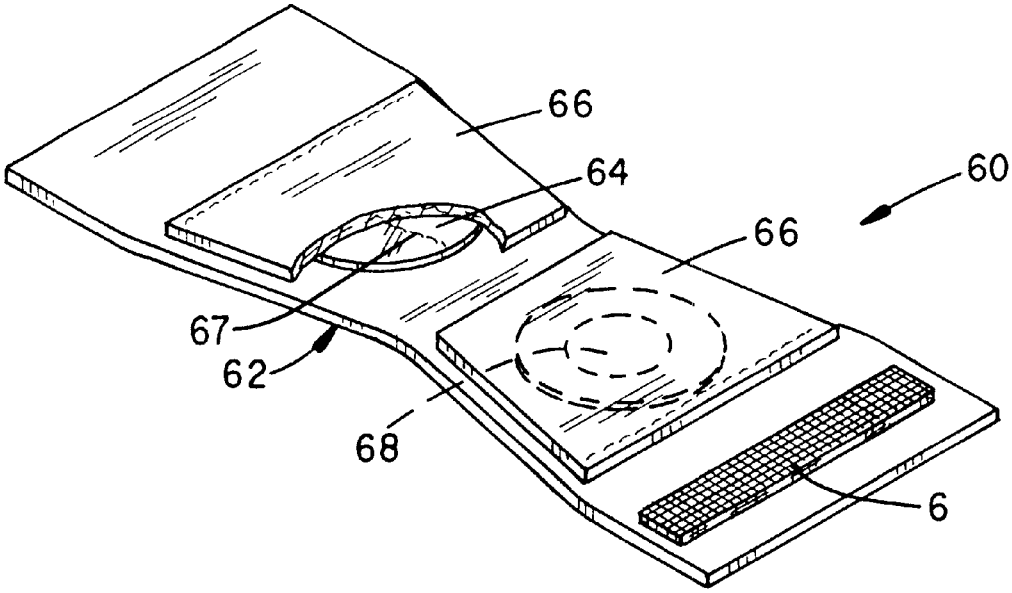
FIG. 7 is a perspective drawing showing an assembly view to the thimble of FIG. 5.

A double-shield thimble 60 is shown at FIGS. 6 and 7 as it appears when sewn together and in partial assembly. The thimble 60 does not include a pull flap 12. Instead, the body member 62 is cut short. One or more abbreviated pull-tabs 11 shown in dashed line at FIG. 7 can be included though as desired. Two impenetrable shields 64 are supported behind backer tabs 66. The shields 64 can be formed from a variety of materials, although as depicted a high-density plastic is used that can be sewn to the body 4. When stitched together the tabs 66 and/or stitching 67 locate and contain the shields 64 in a preferred orientation to the thimble 60.

The shields 52 and 64 can be constructed of any desired material that thwarts needle penetration. Shields 64 constructed of different materials can be mounted to the opposite sides of the thimble 60. The user can thus rotate the thimble 60 to present a preferred working surface. For example, a hard plastic shield 64 can be mounted to one side and a metallic shield 64 can be mounted behind the other backer 58. A metallic shield 64, if used, can include dimples 54 or not as desired. A braided, chain mail type of material can also be used as a shield. Such a material is very flexible and resistant to penetration. One or both shields 64 can also be exposed through aligned apertures 68 and the body member 62.

Figure 8:
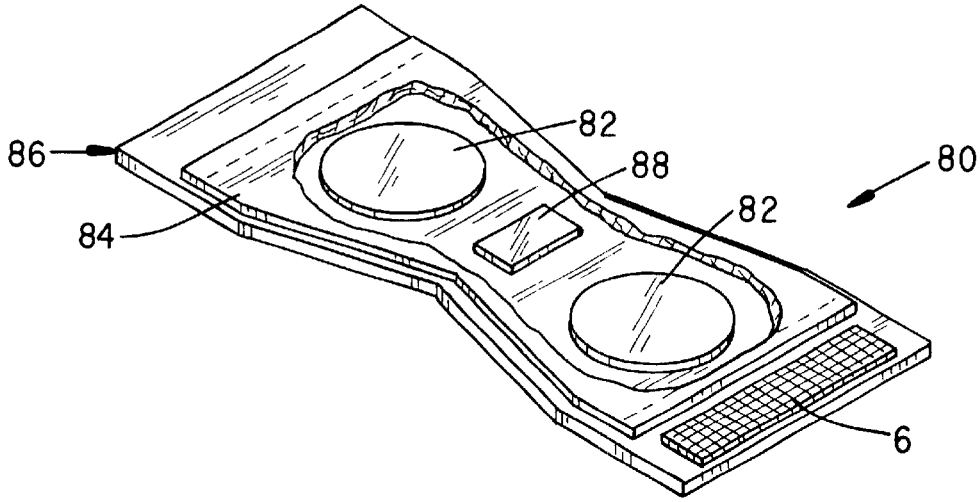
FIG. 8 is a perspective drawing showing an assembly view to a leather thimble without a pull flap that has a rigid end piece and two rigid shield pieces.

FIG. 8 shows an assembly view of another two-sided thimble 80 that doesn't include a pull-tab 6. A backer tab 84 contains a pair of shields 82 to a body member 86. The single tab 84 also covers a third shield 88. The shields 82 protect the fingertip and the shield 88 protects the end of the finger. When sewn together, the thimble 80 exhibits an appearance similar to the thimble 60. The thimble 80 however provides protection to a larger surface area of the distal phalange. The thimble 80 also protects the end of the finger, which was not possible with predecessor hand and finger covers. The shield 88 limits the compression of the thimble and reduces possible blood occlusion. One or more abbreviated pull-tabs 11 shown in dashed line at FIG. 8 can be included as desired.

Figure 9:
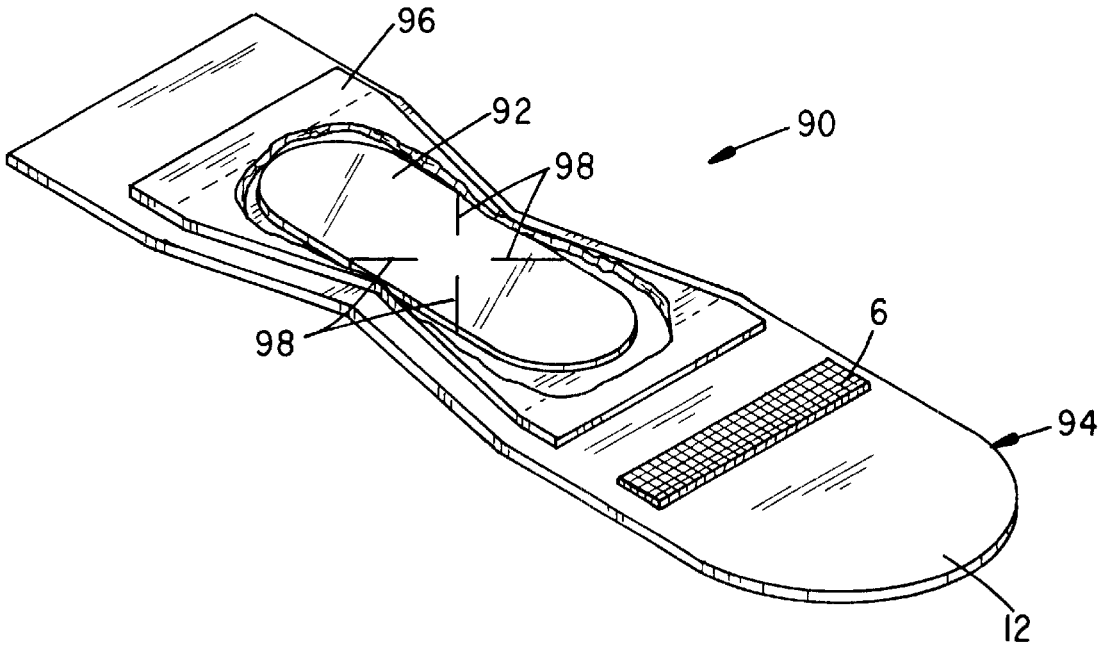
FIG. 9 is a perspective drawing showing an assembly view to a leather thimble with a pull flap that has a rigid, slotted shield piece that encases the distal phalange of a finger.

FIG. 9 discloses another two-sided thimble 90 that protects and encases the tip and end of a finger. An elongated shield 92 is secured to a body member 94 beneath a backer tab 96. The shield 92 is constructed of a pliable, impenetrable material. The shield 92 spans a sufficient length to protect the tip, front and back of the finger when folded to a U-shape. Only the sides of the finger are exposed. The thimble 90 can thus be rotated as either of the working surfaces of the thimble 90 wears with use.

Slots 98 are cut into the shield 92 to facilitate folding the shield 92 and stitching the backer tab 96 and body 94 together. The slots 98 are positioned as desired to provide a preferred folding. The slots 98 also reduce pinching of the finger by the thimble and possible blood occlusion. The shield 92 and/or body 94 can be cut to a variety of preferred shapes. The shield 92 can also include any desired arrangement of slits, slots or cutouts. One or more abbreviated pull-tabs 11 shown in dashed line at FIG. 9 can be included as desired and depending whether a primary pull-tab 12 is included.

Figure 10:
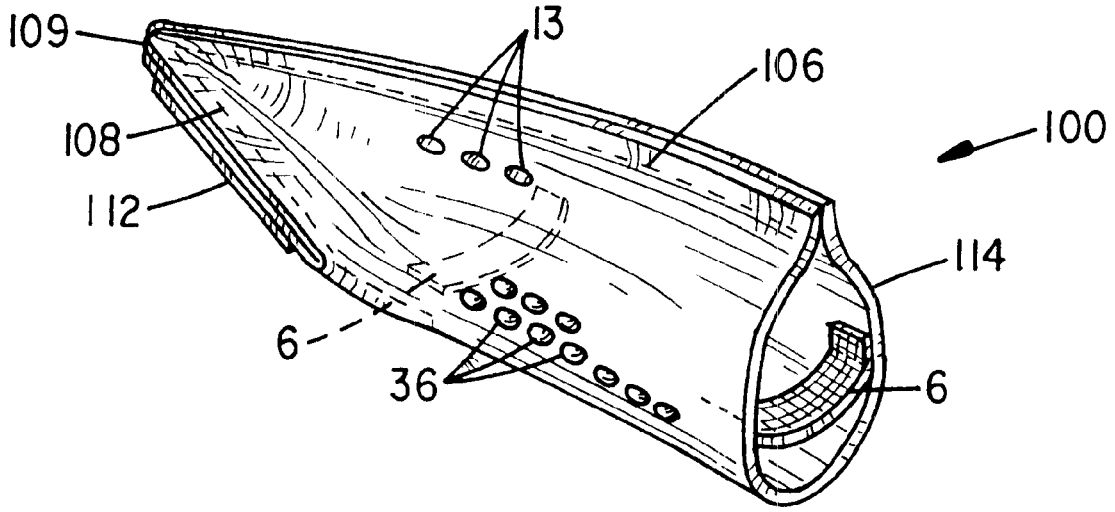
FIG. 10 is a perspective drawing showing a tapered, single longitudinal seam to a leather thimble having a raised rubber pad and coated with elastomer bumps.
Figure 11:
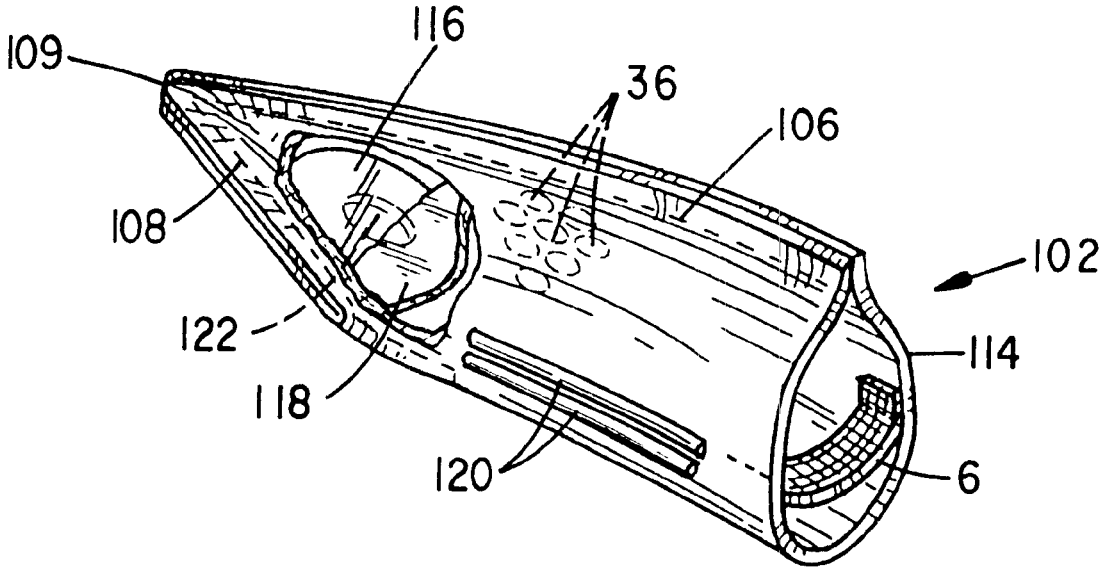
FIG. 11 is a perspective drawing showing a leather thimble similar to that of FIG. 10 with a rigid internal shield piece and coated with elastomer bumps.
Figure 12:
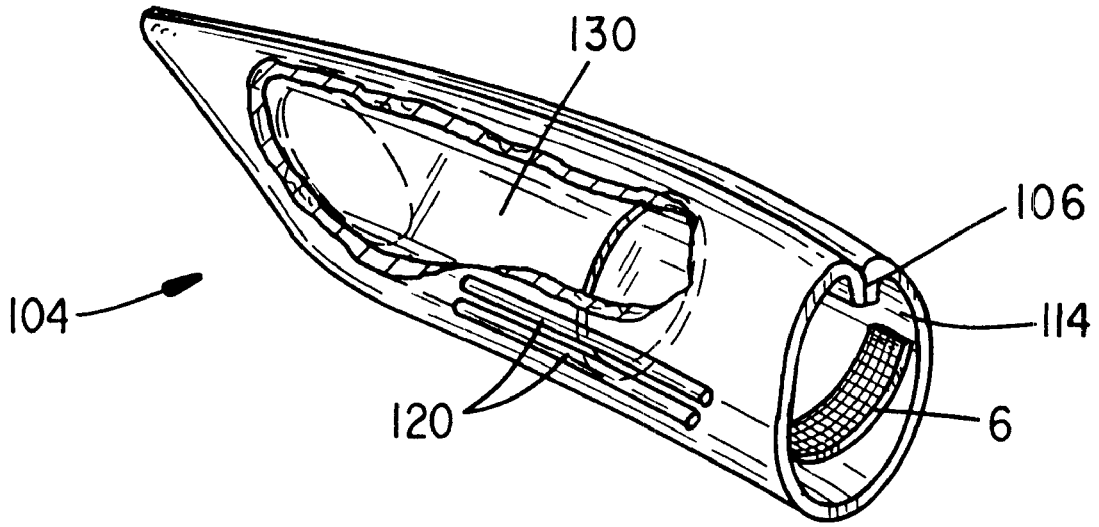
FIG. 12 is a perspective drawing showing an assembly view to a leather thimble similar to that of FIG. 10 wherein the seams are inverted into the interior of the thimble and a tapered, open ended impenetrable sleeve mounts around the fingertip.

FIGS. 10 through 12 show yet other thimbles 100, 102 and 104 that are cut to provide a single longitudinal dorsal seam 106. The seam 106 extends along the dorsal surface of the thimbles 100, 102 and 104. Relatively short seams 108 extend along the lateral edges of the tip 109 and define a tapered end to the thimbles 100, 102 and 104 when assembled. The degree of taper at the tip 109 can be adjusted by varying the cutting and stitching at the forward edge 110 of the body material, reference FIG. 12. The aft end of the thimbles 100, 102 and 104 can be cut to provide a straight edge or can be extended or radiused as shown in dashed line to provide an edge that serves as a pull-tab 101.

The single dorsal seam 106 provides advantages to users who wear a thimble for several hours. The dorsal seam 106 and tapered seams 108 particularly limit contact between the thimble and adjoining fingers. Instead of contacting the seams 8, the fingers contact the relative soft material at the thimble sides. Finger abrasion is thereby avoided. The seam 106 can be inverted such as at the thimble 104, reference FIG. 12.

With attention to FIG. 10, the thimble 100 includes an elastomer pad 112 that is exposed at the work surface. The pad 112 may comprise an elastomer material. In lieu of a pad 112, a raised, patterned coating of a high friction material can be applied to the work surface of the thimble 100, such as the bumps 36. The shape of the pad 112 is cut to provide a desired work surface. The pad 112 can either be sewn to the outer surface of the thimble 100 or be exposed through an aperture cut into the body 114. A sizing member 6 is mounted to span the interior bore of the thimble 100. Air vents 13 (shown in dashed line) can be let into the body 114.

The thimble 102 of FIG. 11 is similar to the thimble 100 but includes an impenetrable shield 116 and backing piece 118. A patterned elastomer coating in the form of bumps 36 or striations 120 can be applied to the exterior of the thimble 102. The shield 116 can be covered by the body 114 or be exposed through an aperture 122 shown in dashed line.

The thimble 104 of FIG. 12 is similar to the thimbles 100 and 102 but includes an impenetrable tubular sleeve that defines a shield 130. A series of patterned elastomer striations 120 are applied to the exterior of the thimble 102. Portions of the shield 130 can be exposed at appropriate apertures 122 cut through the body 114.

Figure 13:
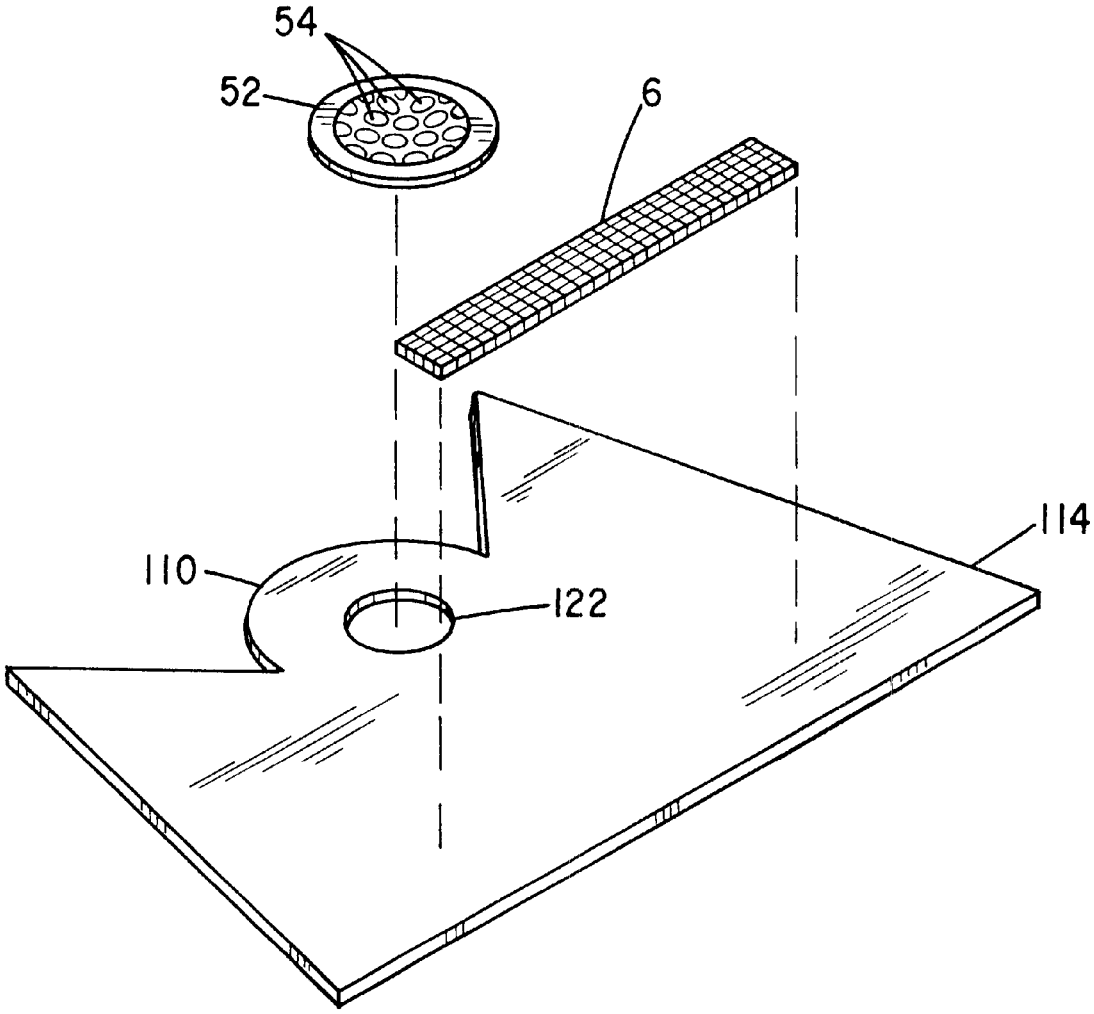
FIG. 13 is a perspective drawing showing an assembly view to a leather thimble similar to that of FIG. 10 with an exposed, pitted finger protector at the work surface.

FIG. 13 depicts an assembly drawing of the material from which the body 114 is formed for the thimbles 100, 102 and 104. The aperture 122 is not required for the thimbles 100 and 102. The shield piece 52 can be covered with a backing piece or can be stitched into place. In lieu of pitting 54 at the shield 52, the shield 52 can include raised projections of various shapes, such as conical or pyramidal points, knurling etc., to facilitate gripping work materials other than paper.

FIGS. 14 through 18 depict still other alternative, wrist-supported thimble/glove assemblies. That is, one or more fingertips are protected with glove-like assemblies that are supported to a hand at selected fingers and the wrist. Each finger piece includes an appropriate impenetrable shield and/or grip-enhancing surface. Depending upon the application, any of the shields and/or grip-enhancing treatments disclosed herein can be incorporated in any desired combination into the various wrist-supported thimbles. Shielded protection can also be included at both the anterior and posterior surfaces of the glove. The gloves can be constructed from any desired pliable material, for example, leather, fabric or rubber among other materials.

Figure 14:
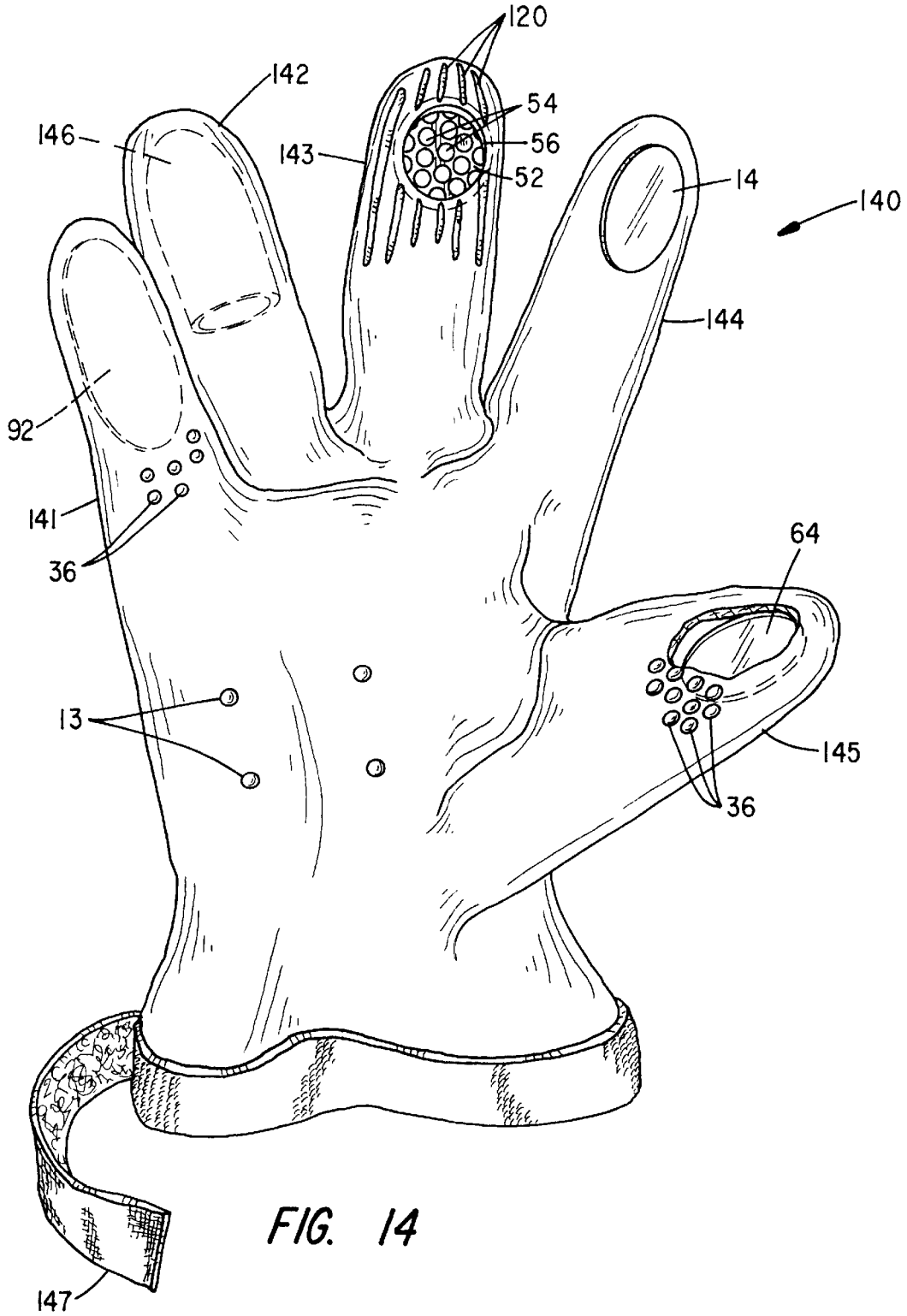
FIG. 14 is a drawing showing a view to a wrist supported glove assembly wherein a variety of exemplary, alternative gripping surfaces and protective shields are depicted at the fingertips.

FIG. 14 shows a full glove 140 that includes a number of alternative types of grip-enhancing surfaces and shields that can be fitted to the finger and thumb pieces 141–145. The glove 140 covers the entire hand, although can be constructed to cover only selected fingers as discussed below. A length adjustable wrist strap 147 is fitted to the wrist portion of the glove 140. Depending upon the application, one or more of the finger pieces 141–145 can be constructed with a variety of gripping and shielding assemblies to protect the fingers from needles etc. and/or facilitate gripping work objects. For example, a full rubber glove with appropriate shield(s) can be used in a surgical suite during stitching procedures. The latter glove may also not require elastomer grip-enhancing protrusions or a wrist strap 147, due to the properties of the rubber itself.

Among numerous possible finger arrangements, the finger piece 141 includes a U-shaped, open-sided shield piece 92 and coated elastomer bumps 36. The finger piece 142 includes a closed ended shield piece 146. The shield piece 146 can be molded from plastic or another impenetrable material and is secured to the finger piece 142 with an adhesive or stitching. The piece 146 is shaped to conform to the fingertip. The finger piece 143 includes a shield piece 52 with recesses 54 that is exposed at a hole 56. Elastomer striations 120 are coated onto the finger piece 143. The finger piece 144 includes an elastomer pad 14 or other laminated grip-enhancing surface. The thumb piece 145 includes a shield piece 64 secured to the interior surface and coated elastomer bumps 36. The specific location and arrangement of shields and/or gripping surfaces can be altered as desired. Vent holes 13 can also be provided as desired about the glove 140.

Figure 15:
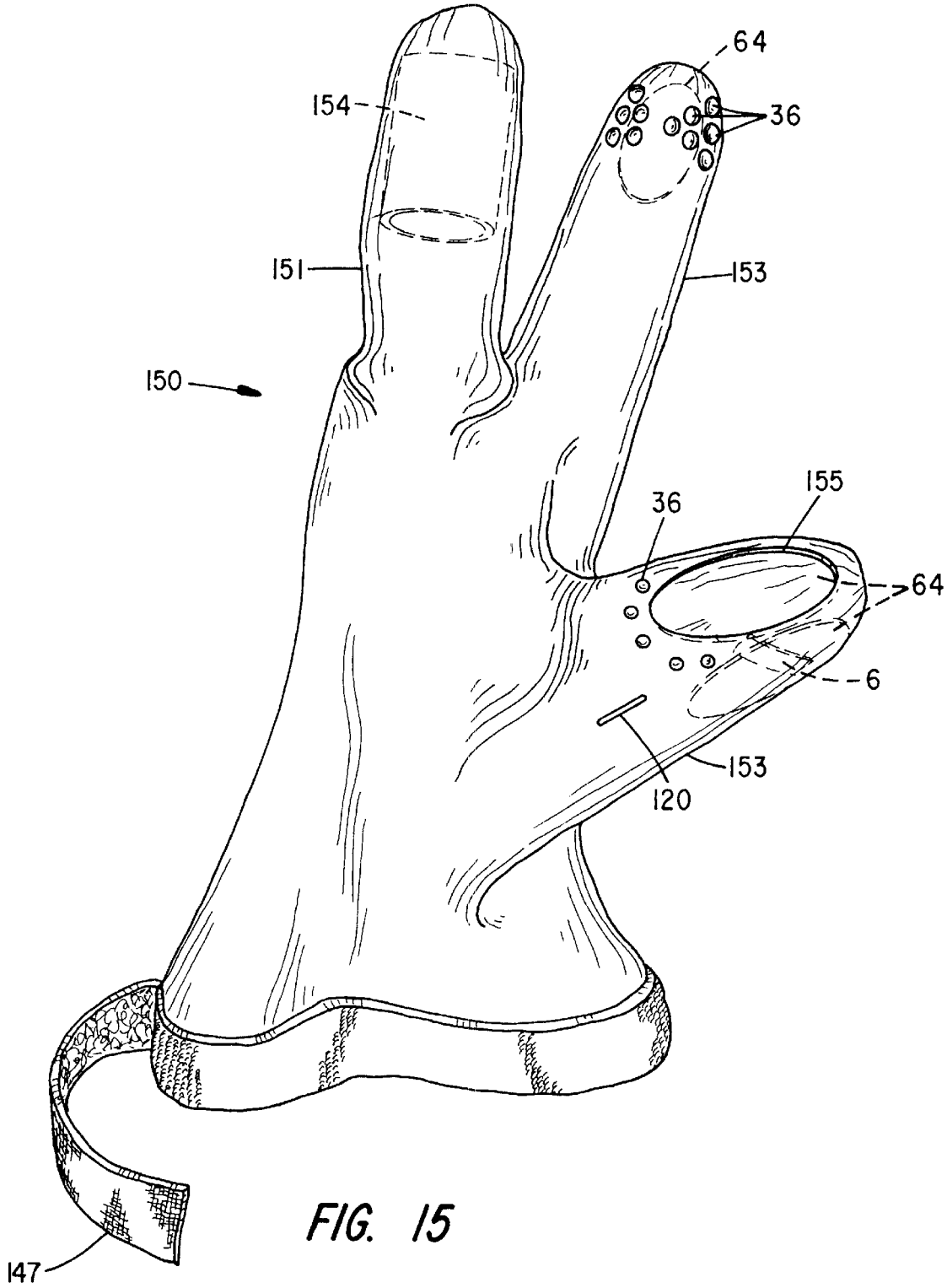
FIG. 15 is a drawing showing a view to a wrist supported thimble assembly that covers two fingers and the thumb and includes exemplary gripping surfaces and protective shields at the fingertips that are shown in cutaway.

FIG. 15 shows a wrist mounted, two-finger and thumb assembly 150. The finger piece 151 includes a tubular open-ended shield piece 154. The finger piece 153 includes pattern coated elastomer bumps 36 and an internal shield 64. The thumb piece 153 includes a pair of shield pieces 64, although one or the other can be deleted as desired. One shield piece 64 is exposed at a hole 155 and the other is secured to the opposite interior surface. An elastic sizing member 6 is also included in the region of the fingernail as a backing for the shield piece 64 and/or facilitate fitting. Grip-enhancing projections 36 and/or striations 120 can also be included.

Figure 16:
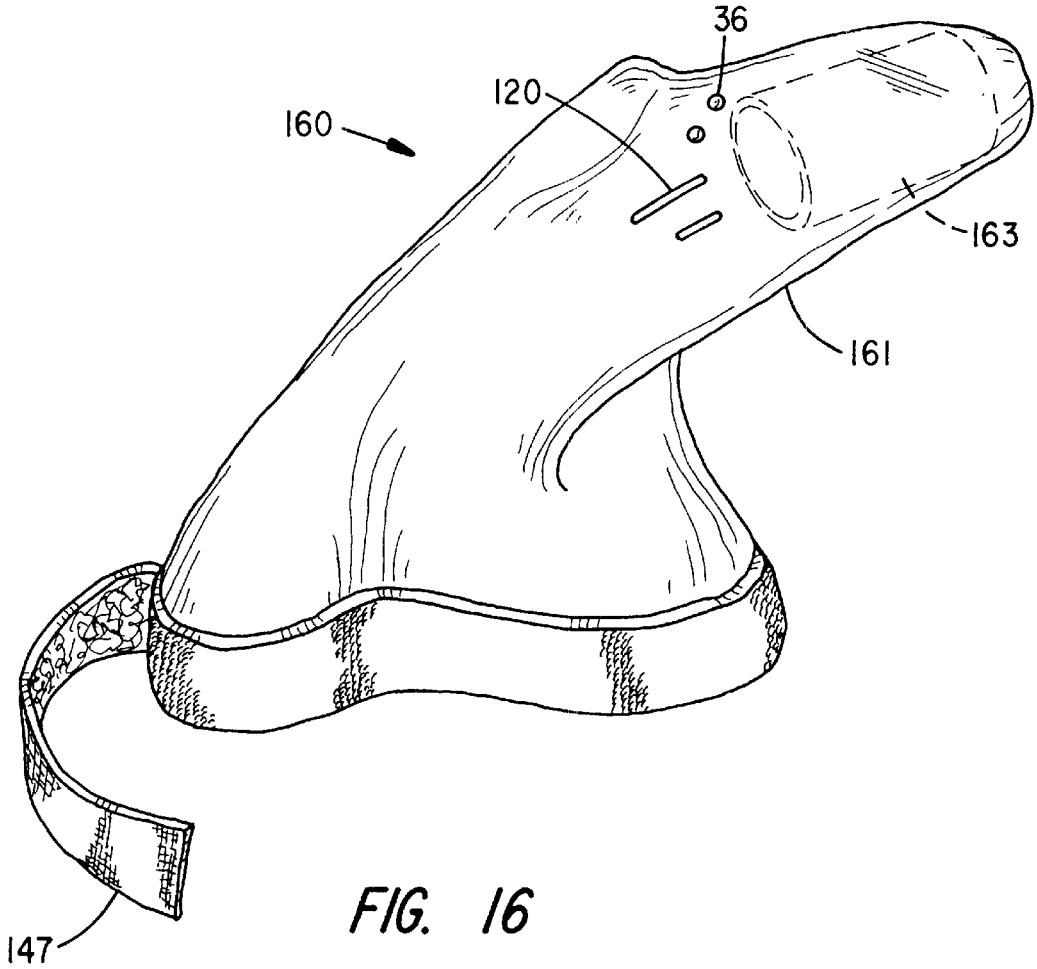
FIG. 16 is a drawing showing a view to a wrist supported thimble assembly wherein an exemplary gripping surface and protective shield is provided at a single fingertip.

FIG. 16 shows a one-finger wrist mounted assembly 160. Although the assembly 160 is intended to protect the thumb, the finger piece 161 can be arranged to protect any fingertip. The finger piece 161 includes a tubular, open-ended shield piece 163. Coated elastomer protrusions 36 or 120 can be provided at any gripping surface.

Figure 17:
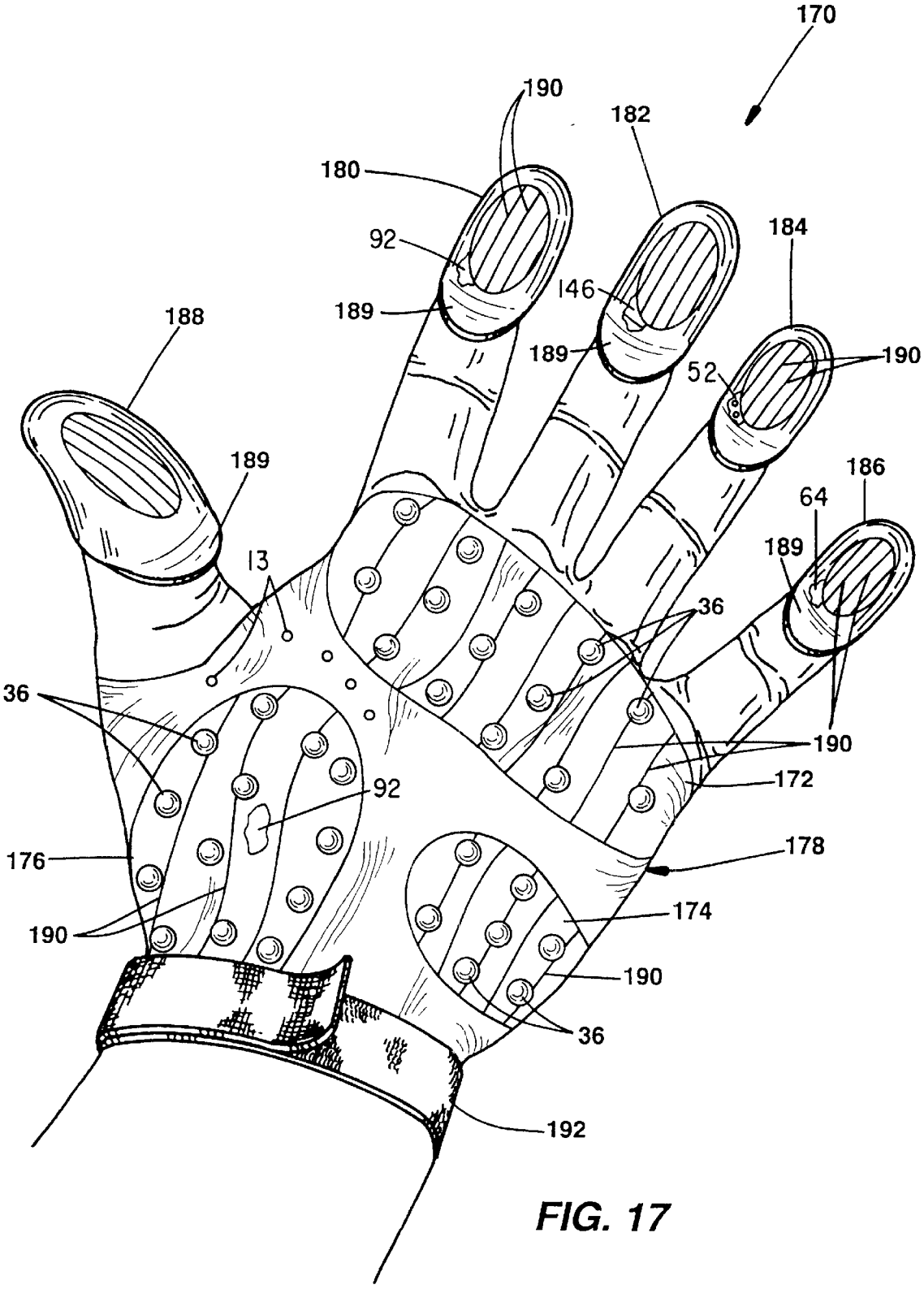
FIG. 17 is a drawing showing a view to a partial glove-thimble assembly wherein a number of padded, elastomer coated regions are provided at the palm and the fingertips are protected by finger pieces supporting exemplary gripping surfaces and protective shields.

FIG. 17 shows a partial glove and finger thimble assembly 170 wherein a number of padded regions 172, 174 and 176 are provided at the palm piece 178. A number of finger pieces 182–186 and a thumb-piece 188 mount over the fingertips. The finger and thumb pieces 182–188 include elastomer striations 190 or other grip-enhancing coatings or laminates at the exterior surface. Arcuate pull-tabs 189 protrude from the edges of the finger and thumb pieces 182–188 to provide a gripping surface to facilitate fitting the finger and thumb pieces 182–188 to the hand. The number of thumb and finger pieces 182–188 can be less than five and several fingers can be mounted in a single multi-finger piece. A variety of protective shields (e.g. 52, 64, 92, 146 or any others disclosed herein) can be fitted in any desired arrangement to the finger pieces 182–188 to protect the fingertips.

Each of the padded palm regions 172–176 is also coated with a desired pattern of bumps 36 and/or striations 190 to facilitate gripping. A wrist strap 192 retains the assembly 170 to the hand. Appropriate fasteners (e.g. snap, hook and loop clips or material) secure the strap pieces together and control the fit.

The palm piece 178 can be constructed of a variety of pliant materials including leather, elasticized fabrics and elastomers. The necessity of bumps 36 and/or striations 190 will depend upon the gripping qualities of the selected material relative to the typical work object. The number and location of the padded regions can be varied as necessary to accommodate the work object and provide enhanced gripping and protection. A variety of cushioning materials (e.g. elastomer, foam, leather, gel pacs etc) can be mounted beneath the regions 172–176. Hardened protective shields shaped to complement the palm regions 172–176 may also be included inside the padded palm regions 172–176. As required, ventilation holes 13 can also be included.

Figure 18:
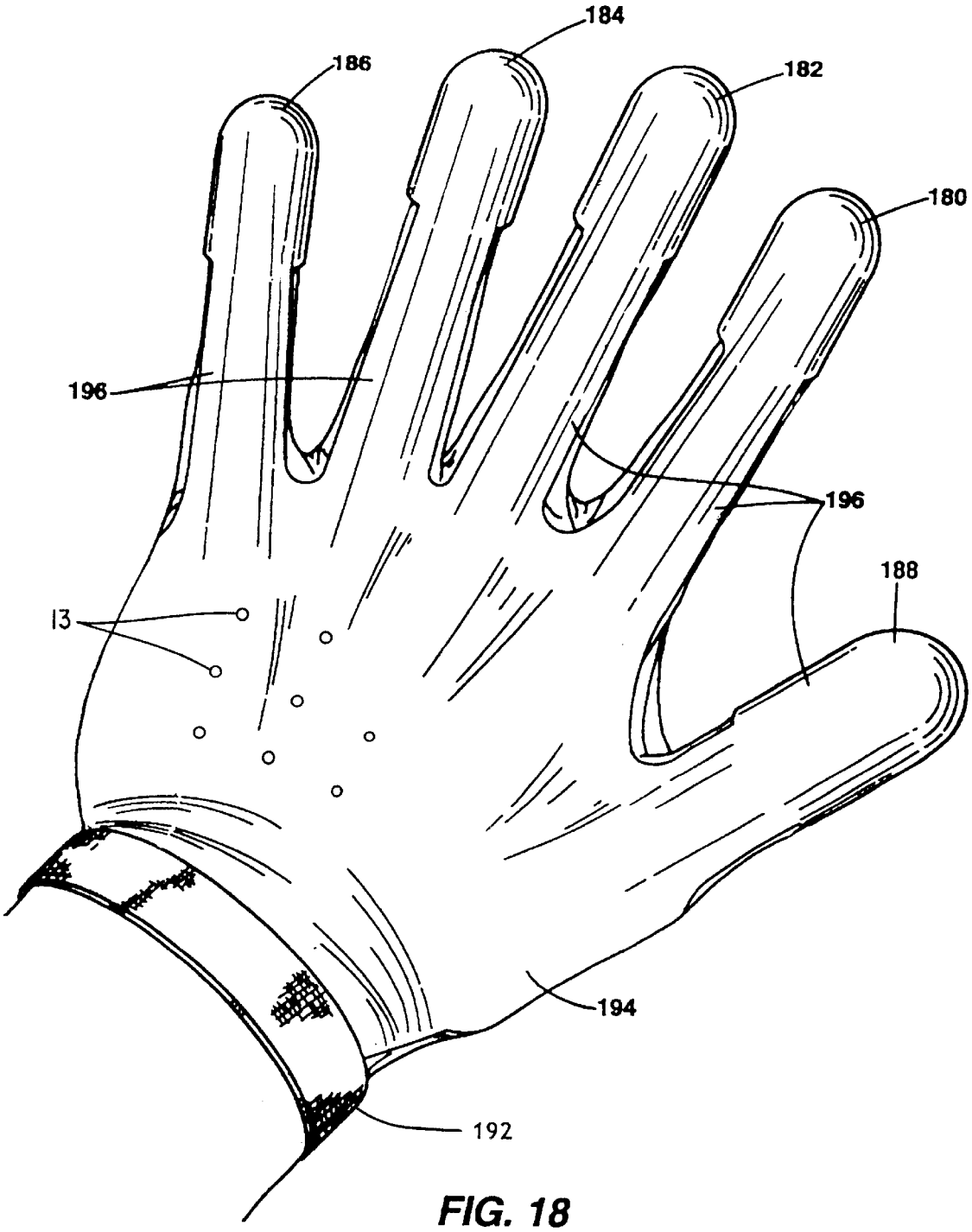
FIG. 18 is a drawing showing a view of the rear surface of the partial glove-thimble assembly of FIG. 17 and wherein webs extend between a back cover piece and the finger pieces.

FIG. 18 shows a view to the rear surface of the partial glove-thimble assembly 170. A back cover piece 194 extends from the wrist strap 192 and a number of webs 196 extend between the back cover 194 and the finger and thumb pieces 182–188. The webs 196 can be constructed from the same material as the cover 194 and/or may be elasticized to facilitate the fitting and retention of the finger pieces 180–188. The back cover 194 can be ventilated with holes 13 or can include a number of larger cutout openings.

While the invention has been described with respect to a number of preferred assemblies and considered improvements or alternatives thereto, still other assemblies may be suggested to those skilled in the art. Selected ones of the foregoing features can also be applied alone or arranged in different combinations at still other thimbles and/or glove or mitten type hand wear. The foregoing description should therefore be construed to include all those embodiments within the spirit and scope of the following claims.

What is claimed is:

1. A protective hand cover comprising a pliable sheath constructed to cover a portion of the hand and wrist and including a wrist retainer and at least one closed ended finger piece and wherein a rigid, penetration resistant member is mounted to and exposed through an aperture the finger piece.

2. A cover as set forth in claim 1 wherein said rigid member comprises a tubular piece fitted to the interior said finger piece.

3. A cover as set forth in claim 1 wherein an outer surface of said finger pieces are coated with an elastomer material.

4. A protective hand cover comprising a pliable sheath constructed to cover a portion of the hand and wrist and including a wrist retainer and a plurality of closed ended finger pieces, wherein a rigid, penetration resistant member is mounted to a distal end of each of said finger pieces, and wherein at least one of said rigid members is exposed through an aperture of said sheath.

5. A cover as set forth in claim 4 wherein an outer surface of said sheath is coated with an elastomer material.

6. A cover as set forth in claim 5 wherein said elastomer material is applied as a patterned coating.

7. A cover as set forth in claim 6 wherein said elastomer material comprises a patterned coating of spots.

8. A cover as set forth in claim 6 wherein said elastomer material comprises a patterned coating of stripes.

9. A cover as set forth in claim 1 wherein the aperture is in the ventral surface of said finger piece.

10. A cover as set forth in claim 1 wherein at least one of said finger pieces includes first and second rigid members mounted adjacent dorsal and ventral surfaces of said sheath.

11. A cover as set forth in claim 4 wherein at least one of said rigid members comprises a tubular piece fitted to the interior of said finger piece.

12. A protective hand cover comprising a pliable sheath constructed to cover a portion of the hand and wrist and including a wrist retainer and a plurality of closed ended finger pieces, wherein a rigid, penetration resistant member is mounted to a distal end of each of said finger pieces, wherein at least one of said finger pieces includes first and second rigid members mounted adjacent dorsal and ventral surfaces of said sheath, and wherein at least on of said rigid members is exposed through an aperture of said sheath.

13. A cover as set forth in claim 1 wherein said wrist retainer comprises a strap that extends from said sheath and means for securing said strap to retain the sheath to the hand.

* * * * *

UNITED STATES PATENT AND TRADEMARK OFFICE

CERTIFICATE OF CORRECTION

PATENT NO. : 6,640,341 B1
DATED : November 4, 2003
INVENTOR(S) : Nathaniel Calvert It is certified that error appears in the above-identified patent and that said Letters Patent is hereby corrected as shown below:

Column 8,
Line 36, after "aperture" insert -- of --

Signed and Sealed this

Tenth Day of February, 2004

JON W. DUDAS
*Acting Director of the United States Patent and Trademark Office*